US009963338B2

(12) United States Patent
Diffenderfer

(10) Patent No.: US 9,963,338 B2
(45) Date of Patent: May 8, 2018

(54) SYSTEM AND METHOD FOR POURING WINE BY THE GLASS

(71) Applicant: Miavina LLC, Miami Beach, FL (US)

(72) Inventor: Cindy Diffenderfer, Miami Beach, FL (US)

(73) Assignee: Miavina LLC, Miami Beach, FL (US)

( * ) Notice: Subject to any disclaimer, the term of this patent is extended or adjusted under 35 U.S.C. 154(b) by 59 days.

(21) Appl. No.: 14/959,656

(22) Filed: Dec. 4, 2015

(65) Prior Publication Data

US 2016/0159633 A1 Jun. 9, 2016

Related U.S. Application Data

(60) Provisional application No. 62/088,082, filed on Dec. 5, 2014.

(51) Int. Cl.
*B67D 1/00* (2006.01)
*B67D 1/04* (2006.01)
(Continued)

(52) U.S. Cl.
CPC ..... *B67D 1/0884* (2013.01); *B67D 1/0004* (2013.01); *B67D 1/0406* (2013.01); *B67D 1/0857* (2013.01); *B67D 1/0877* (2013.01); *B67D 1/0882* (2013.01); *B67D 1/0885* (2013.01); *B67D 1/0888* (2013.01); *B67D 1/0889* (2013.01); *B67D 1/0895* (2013.01); *B67D 1/1229* (2013.01); *B67D 3/0006* (2013.01); *B67D 3/0009* (2013.01); *B67D 3/0022* (2013.01); *B67D 3/0029* (2013.01);
(Continued)

(58) Field of Classification Search
CPC .. B67D 1/0884; B67D 1/0004; B67D 1/0412; B67D 1/0888; B67D 1/0857; B67D 1/0895; B67D 3/0006; B67D 1/0882; B67D 3/0022; B67D 3/0029; B67D 3/0083; B67D 3/0096; B67D 1/0406; B67D 1/0877; B67D 1/0885; B67D 1/0889; B67D 1/1229; B67D 3/0009; B67D 2001/0481; B67D 2001/0811; B67D 2001/1263; B67D 2210/00089; B67D 2210/00091
See application file for complete search history.

(56) References Cited

U.S. PATENT DOCUMENTS 4,595,121 A * 6/1986 Schultz ..... B01F 5/0413 116/DIG. 8
4,932,561 A * 6/1990 Boxall ..... B67D 1/04 137/487.5
(Continued)

FOREIGN PATENT DOCUMENTS

WO WO 2015/153598 10/2015

*Primary Examiner* — Frederick C Nicolas
(74) *Attorney, Agent, or Firm* — Dorsey & Whitney LLP

(57) ABSTRACT

A Wi-Fi connected wine preservation and optimization system, device and method. The system offers preservation by the minimization and/or elimination of oxygen, temperature control, inventory tracking, monitoring and reordering through user terminals such as e.g., a Wi-Fi connected tablet (e.g., iPad), smart phones, computers, etc. The data aggregated will be available on a subscription basis available for purchase by the trade, retailers, producers and distributors to enable strong controls on production and inventory resulting in higher profits and lower waste.

18 Claims, 9 Drawing Sheets

(51) Int. Cl.
*B67D 1/08* (2006.01)
*B67D 3/00* (2006.01)
*B67D 1/12* (2006.01)

(52) U.S. Cl.
CPC ..... *B67D 3/0083* (2013.01); *B67D 3/0096* (2013.01); *B67D 2001/0481* (2013.01); *B67D 2001/0811* (2013.01); *B67D 2001/1263* (2013.01); *B67D 2210/00089* (2013.01); *B67D 2210/00091* (2013.01)

(56) References Cited

U.S. PATENT DOCUMENTS 7,464,567 B1 * 12/2008 Crossley ..... F25D 3/08 220/345.1
8,596,496 B2 12/2013 Malinski
8,820,094 B1 2/2014 Casher et al.
8,800,814 B2 8/2014 Braun et al.
8,899,445 B2 * 12/2014 Rasmussen ..... B67D 1/0462 222/105
2005/0211728 A1 * 9/2005 Wang ..... B67D 3/0009 222/146.6
2006/0151528 A1 7/2006 Wauters et al.
2006/0175355 A1 * 8/2006 Glucksman ..... B67D 1/0425 222/209
2007/0245765 A1 10/2007 Casher
2009/0236368 A1 * 9/2009 Coon ..... C12H 1/22 222/152
2011/0168775 A1 7/2011 Van Zetten
2011/0253746 A1 10/2011 O'Keefe, Jr.
2011/0290822 A1 * 12/2011 Bouwer ..... B65D 23/065 222/108
2014/0097201 A1 * 4/2014 Otto ..... B67D 3/00 222/95
2015/0284163 A1 10/2015 Manwani et al.

* cited by examiner

SYSTEM AND METHOD FOR POURING WINE BY THE GLASS

CROSS REFERENCE TO RELATED APPLICATIONS

This application claims priority from U.S. Provisional Application Ser. No. 62/088,082, filed Dec. 5, 2014, the entirety of which is incorporated herein by reference.

FIELD OF THE INVENTION

Embodiments of the invention relate to a system and method for pouring wine-by-the-glass on-tap in a self-contained, temperature controlled, Wi-Fi-connected, dispensing system.

BACKGROUND

Wine begins to oxidize the moment the package is opened resulting in large amounts of spoiled or lost liquid. The current bottle packing is cumbersome and inefficient creating large amounts unnecessary waste. Producers have no visibility of consumer behavior and real time consumption making it impossible for them to both properly project and produce the appropriate volume of product resulting in inefficient farming practices and over-production. Until recently, it has been illegal to ship wine direct-to-consumer creating expensive, laborious and inefficient distribution methods.

SUMMARY

Embodiments disclosed herein relate to a system and method for pouring wine-by-the glass on tap in a self contained, temperature controlled dispensing system. Liquid is extracted through a gas propulsion or gravity and suction method eliminating the introduction of oxygen creating a perfect environment for stable storage and extending the shelf life of liquid for prolonged optimal consumption.

One embodiment of the system includes both cooling and warming elements to properly control the temperature of liquid as prescribed by either the preset information in an IOT (Internet of Things) library or adjusted to taste by the user. The system has two chambers, offering dual-zone temperature settings and allowing the use of two types of wines (e.g., white and red) to be simultaneously served at respective unique temperatures. The system has a PCB board, which is the brain of the system, that will read information from each of the disclosed subsystems including: weight, depletion rates, temperature, UCC/RFID information and track consumption behavior. The PCB board will transmit information gathered to a cloud computing monitoring software application via a Wi-Fi connection, which will then be updated in each user's application when connected via a wireless device.

The purchasing, consumption and feedback behavior provided by each user will be monitored and interpreted to make curated selections and recommendations for each user based on their interactions with both the application and the system. A bay sensor subsystem will monitor depletion rates and prompt the user for real-time replenishment to ensure that the user never runs out of wine. The QR/UCC reader will identify each new item that enters the system and automatically sets each chamber to the products' ideal pouring temperature. The information transmitted by the PCB board from each system will be aggregated via the Cloud using data inputs such as e.g., age, gender, geographic location, weather, etc., allowing a provider to intelligently target a consumer base for sales, marketing and product introductions.

The disclosed embodiments are intended for both commercial use on premise at bars and restaurants and for in-home consumer use.

Wine dispensed by the system maybe packaged in a proprietary container, referred to herein as a Quartina. The Quartina has a unique valve system that preserves the liquid while dispensing and eliminating the introduction of oxygen into the chamber, extending stabilized shelf life for storage when not in use. The valve system will have one point of entry and one point of exit—gas or limited oxygen in and liquid out. As the tap handle is engaged on the selected chamber, the valve is opened allowing the release of liquid from it's package and displacement with either gas or oxygen or collapse of an inner lining (depending on the vessel). The liquid then travels from the package, through the temperature controlled lines, through the faucet, into the glass. As the liquid is released, the Weigh system in the bay sensors subsystem calculates volume of liquid released and updates the PCB with new inventory levels. This information is transmitted back to the cloud monitoring application and then to the user application to update their immediate new inventory levels. The elimination and minimization of oxygen both into the chamber of each vessel as well as the exposed surface area extends the shelf life of the product for days and weeks at a time. Environmental and human factors will effect the amount of time the product is extended, but it is expected that it will range from 7-10 days for a bottle and about 30 days for a Quartina (as measured from the initial date of opening).

Another embodiment disclosed herein uses a gas-charged system comprising a small chamber of nitrogen gas in addition to other subsystems disclosed herein. The gas will be used as an additional method of liquid preservation by creating a layer of gas over the liquid to protect any surface area from being exposed to oxygen.

DETAILED DESCRIPTION

Figure 1:
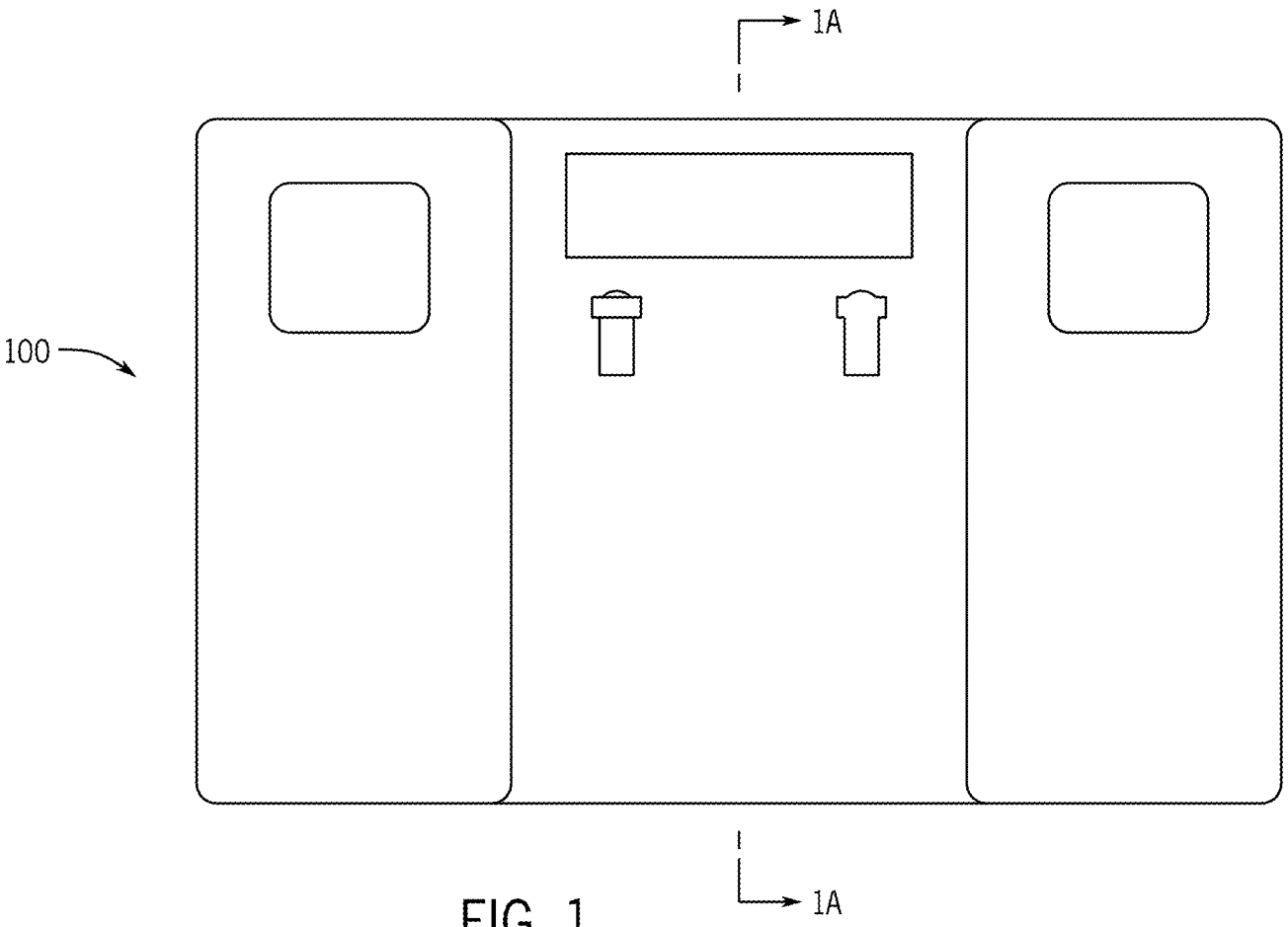
FIG. 1 illustrates an example system in accordance with a disclosed embodiment.
Figure 1A:
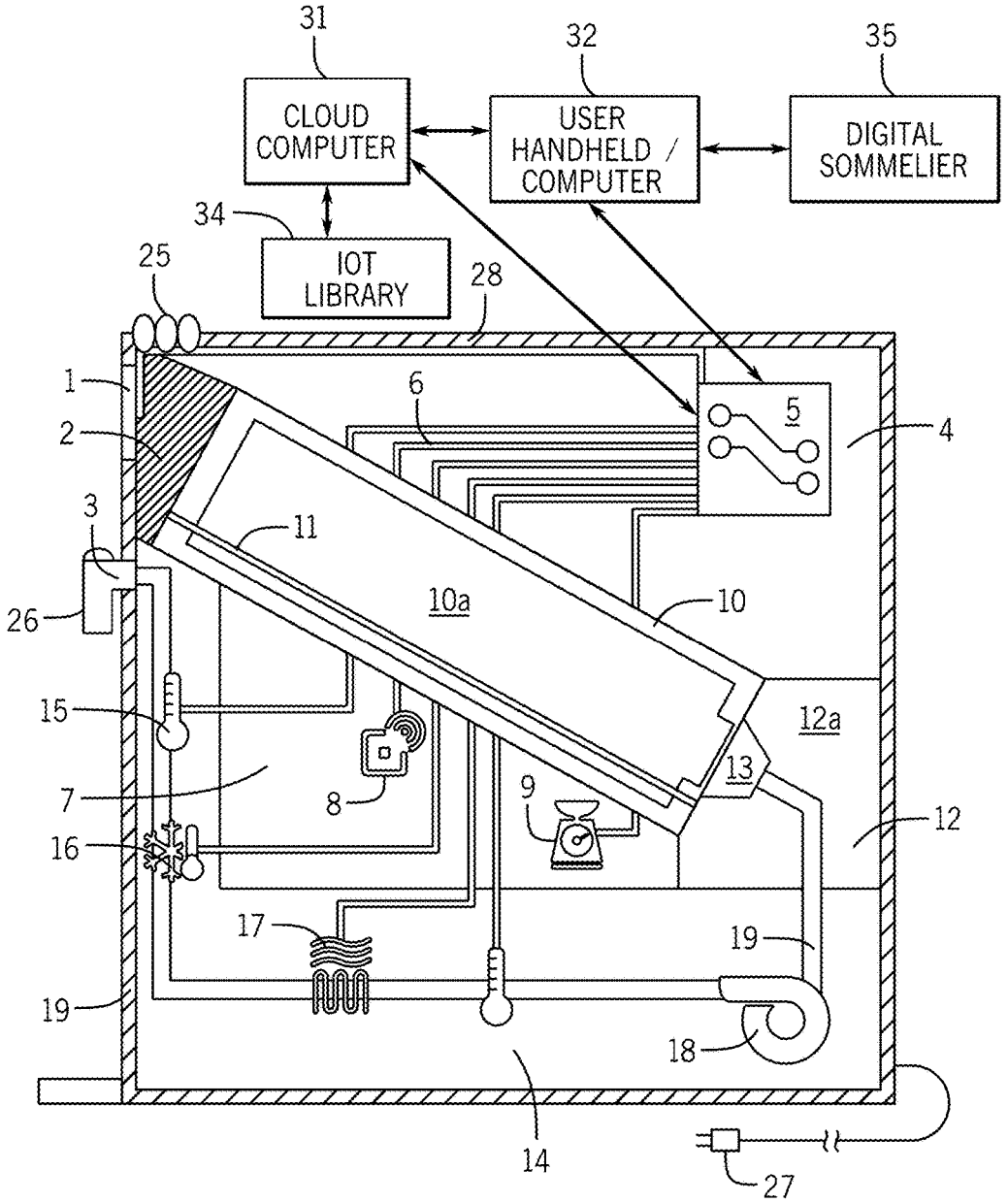
FIG. 1*a* is an illustration of an embodiment of the system using a gravity feed and pump for preservation and propulsion.
Figure 1B:
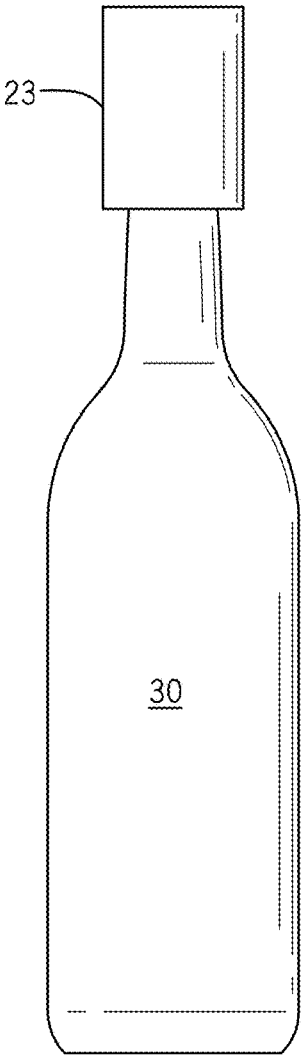
FIG. 1*b* is an illustration of the disclosed magic cork as applied to a traditional wine bottle.
Figure 1C:
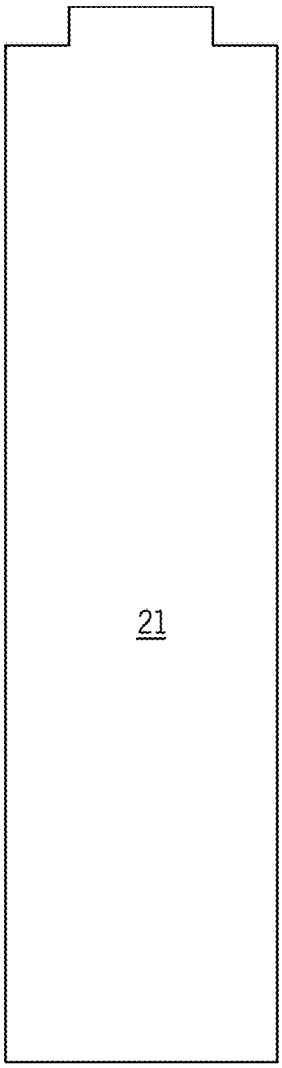
FIG. 1*c* is an illustration of the disclosed Quartina.

In the following detailed description, a plurality of specific details, such as types of materials and dimensions, are set forth in order to provide a thorough understanding of the preferred embodiments discussed below. The details discussed in connection with the preferred embodiments should not be understood to limit the claimed invention. Furthermore, for ease of understanding, certain method steps are delineated as separate steps; however, these steps should not be construed as necessarily distinct nor order dependent in their performance.

FIGS. 1-5 show a system 100 of a first example embodiment disclosed herein. The illustrated system 100 comprises multiple subsystems: PCB subsystem 4, bay sensors subsystem 7, vessel bay rail subsystem 10, vessel dock subsystem 12, fluid line subsystem 14, and vessel subsystems 20, 22 housed in a housing or casing 28. An information display 1 and dispenser 3 are mounted on or attached to the housing. In the illustrated embodiment, the dispenser 3 comprises two spouts, each to be connected to a respective vessel (via the fluid line subsystem 14). It should be appreciated that the dispenser 3 would have a lever or other mechanism for activating the dispenser so that liquid would be dispensed from the spouts. A vessel entrance 2 is also provided through the housing. The components within the housing may be powered by standard electricity via a power cord 27.

The PCB subsystem 4 comprises a PCB Board 5 and connections 6 that transmit via wireless connectivity 44 to a computer/application 31 connected e.g., via the cloud (i.e., Internet). The PCB subsystem 4 is the brain of the system 100 performing or coordinating the functions disclosed herein and, in one embodiment, is a single printed circuit board 5 no larger than 100 square inches. In one embodiment, the PCB board 5 is located high and to the back of the system's housing for easy access to non-visible venting.

The bay sensors subsystem 7 comprises a QR/UCC sensor 8 and a weight sensor 9. The sensors in the bay sensors subsystem 7 allow the system 100 to recognizes fluid vessels introduced therein. Two sets of the sensors will be mounted on or immediately near the vessel bay subsystem 10. In one embodiment, QR/UCC sensor 8 is a QR/UCC code optical reader. In another embodiment, QR/UCC sensor 8 is an RFID sensor. Regardless of how implemented, the QR/UCC sensor 8 identifies the contents of fluid vessels introduced within the system 100. The weight sensor 9 may be a load cell or similar device to accurately measure the change in weight of fluid vessels.

The vessel bay rail subsystem 10 comprises the rail 11 and vessel bay 10*a*. The vessel bay 10*a* is a receptive mechanism that extends out to receive the fluid vessel. It may feature a combination of translational and rotational mechanisms made from either plastic, stamped steel or aluminum.

The vessel dock subsystem 12 comprises a vessel dock 12*a*. The vessel dock 12*a* is a stationary subassembly that presents a valve 13, referred to herein as a "magic valve", to be mated with an adapter 23, referred to herein as a "magic cork", found on the fluid vessel (discussed in more detail below). When the "magic" devices 13, 23 are mated, they will form a water-tight connection that will allow wine to be extracted. Together, the "magic" devices 13, 23 may be cylindrical in shape about 2 inches in diameter and about 3-4 inches in height.

The fluid line subsystem 14 consists of fluid lines 19, temperature sensors 15, cooling pads 16, warming pad 17 and an in-line pump 18. This subsystem 14 exists downstream from the vessel dock subsystem 12 and extends to include the dispenser 3. It should be appreciated the vessel dock subsystem 12 and its vessel dock 12*a* could be considered part of this subsystem 14. Likewise, the fluid line subsystem 14 could be considered to be part of the vessel dock subsystem 12. This subsystem 14 includes fluid lines 19 that may be e.g., two sets of food grade plastics suitable for wine or they may be stainless steel lines. These lines 19 are independent until connected to the dispenser 3. The temperature sensors 15 may be e.g., two pairs of fluid temperature sensors to help control wine temperature. The cooling pad 16 may be e.g., two sets of thermos electric cooling pads (TEC), roughly about sixteen square inches in area and about an inch in height. The warming pad 17 may be e.g., two sets of line heat traces. The pump 18 may be e.g., two sets of food grade plastic or stainless steel pumps.

The vessel subsystems 20, 22 are provided for accepting fluid vessels into the system 100 housing. The system 100 shall accommodate two or more different types of fluid vessels. A wine bottle 30 will require a manual application of the "magic cork" 23 to interface with the "magic valve" 13. The Quartina 21, on the other hand, is equipped with the appropriate adapter/magic cork and is designed to interface with the "magic valve" 13 without additional changes, etc. The Quartina 21 is a fluid vessel that may be a partially or wholly sourced "bag in a box" solution. The magic cork 23 shall provide a uniform mate to the vessel dock subsystem 12 regardless of fluid vessel.

In order to use the system 100, the user will follow the steps as detailed below for each unique new package opened. Initially, the user opens the Quartina 21 or bottle 30 to be introduced into the system 100. If using a Quartina 21, the user will remove a plastic seal and then open the front cover 19 to expose the vessel entrance 2 in the housing. The user will insert the Quartina 21 top down on a slopping vertical angle along the vessel bay subsystem 10 and rail 11. The Quartina 21 will slide along the rail 11 to a resting place at the bottom of the vessel dock 12.

Similarly, if using a bottle 30, the user will uncork the bottle 30 and replace the cork and/or twist cap with a proprietary stopper, referred to herein as a "magic cork" 23. With a bottle 30 and a magic cork 23, the user will follow the same procedure discussed above for the Quartina and slide the bottle 30 complete with magic cork 23 into the vessel bay 10*a* along the rail 11 to engage the vessel dock 12 and the proprietary valve referred to herein as the "magic valve" 13. The Quartina 21 (or bottle 30 and magic cork 23) will engage the vessel dock 12, creating an air-tight seal. Once either the bottle 30 and/or Quartina 21 are in-place in the vessel dock 12, the information display 1 and the PCB board 5 will begin the recognition process and automate the connections 6 to begin sending information from the bay sensors subsystem 7 to the fluid lines subsystem 14. The PCB board 5 will then set the temperature sensor 15 to the appropriate varietal setting and turn on either the cooling pad 16 or warming pad 17 so that the contents of the Quartina 21/bottle 30 is brought to the correct temperature. For example, if the user inserts a Cabernet Sauvignon and the current ambient temperature is 75 degrees and the PCB board 5 determines that the pre-set temperature for said liquid should pour at 59 degrees, the PCB Board 5 will activate the cooling pad 16 to drop the liquid from 75 degrees to 59 degrees prior to pouring from the fluid line 19. Once the temperature is at the predetermined temperature (as determined by the PCB 5 via an input from the temperature sensor 15), the PCB 5 causes the sensor lights 25 to turn on to indicate to a user that the liquid is ready to pour.

In order to pour the liquid from either a Quartina 21 or bottle 30, the user will press the faucet 26 to start the in-line pump 18. The in-line pump 18 will push the liquid from the vessel through the fluid line 19, then through the warming pad 17 and cooling pad 16 to effect the temperature (as discussed above) and the liquid will come through the magic valve 13 and out the faucet 26 as expected and set by the system. As liquid is depleted from the vessels, the PCB 5 tracks released pressure and depletion rate from information from the weight sensor cell 9. Depletion will be tracked from the weight sensor 9 to the corresponding sensor lights 25 on the top of the system exterior casing 28 to indicate decreasing volume levels in the system. The PCB board 5 will transmit date, time and consumption rates back to the cloud computer/application 31 and track consumer drinking patterns. The cloud computer/application 31 will synchronize with the user's application 32 and notify the user of volumes remaining in the system 100. The user may interact with its application 32 and indicate its taste preferences through the IOT library of wines 34 and the digital sommelier 35 will curate recommended selections based on user input and consumption patterns.

Figure 2:
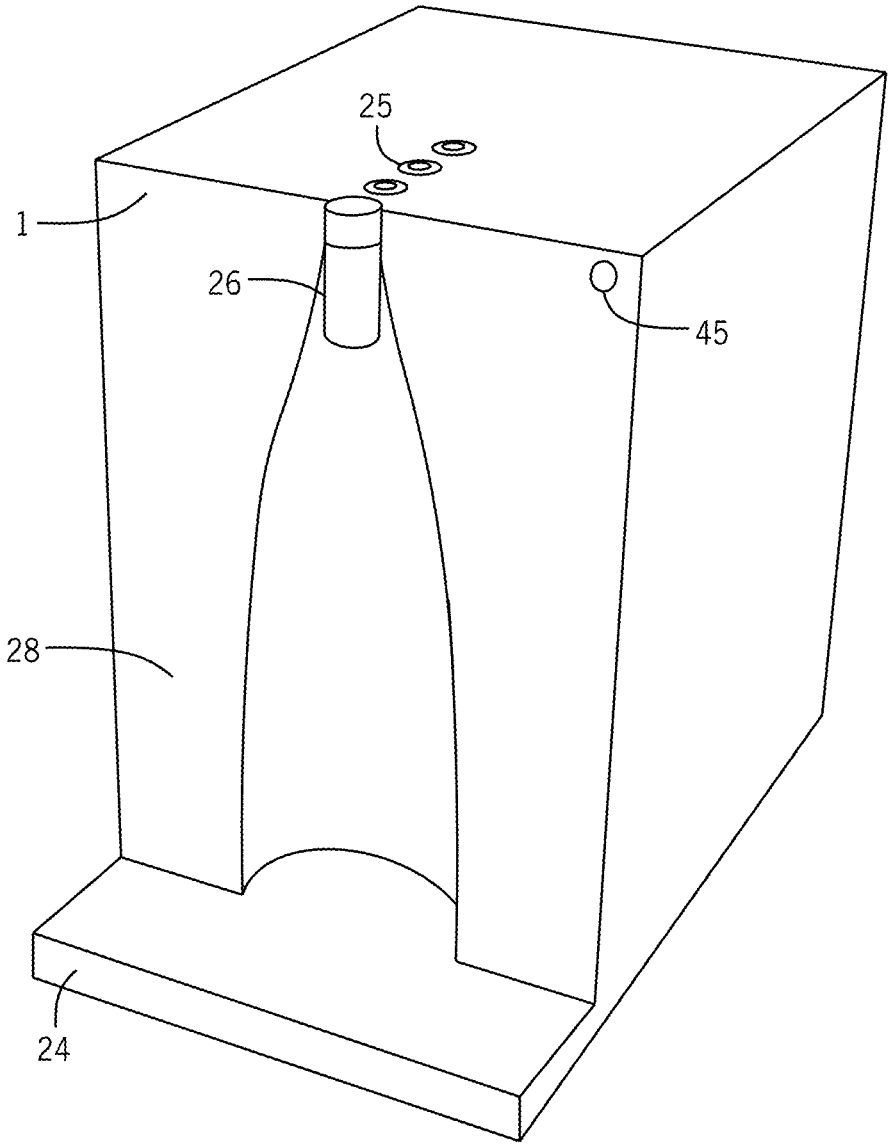
FIG. 2 illustrates the exterior view of one embodiment of the system.

FIG. 2 illustrates an external view of the system 100. The exterior casing 28 will be made up of e.g., eco-friendly plastics and composite wood material. The front cover 19 folds out exposing the internal components of the system 100 with a direct line to the vessel bay 10 for easy, single-handed insertion of either a Quartina 21 or a bottle 30. The exterior casing 28 exhibits an on/off button 45, a faucet 26 for pouring liquid, a fold down drip tray 24 to collect any liquid that drips from the faucet 26 during or following pouring. The volume sensor lights 25 indicate liquid levels remaining in each of the vessel chambers. The information display 1 provides e.g., information as dictated by the user, including but not limited to brand, varietal, temperature, volume remaining and appellation.

Figure 3:
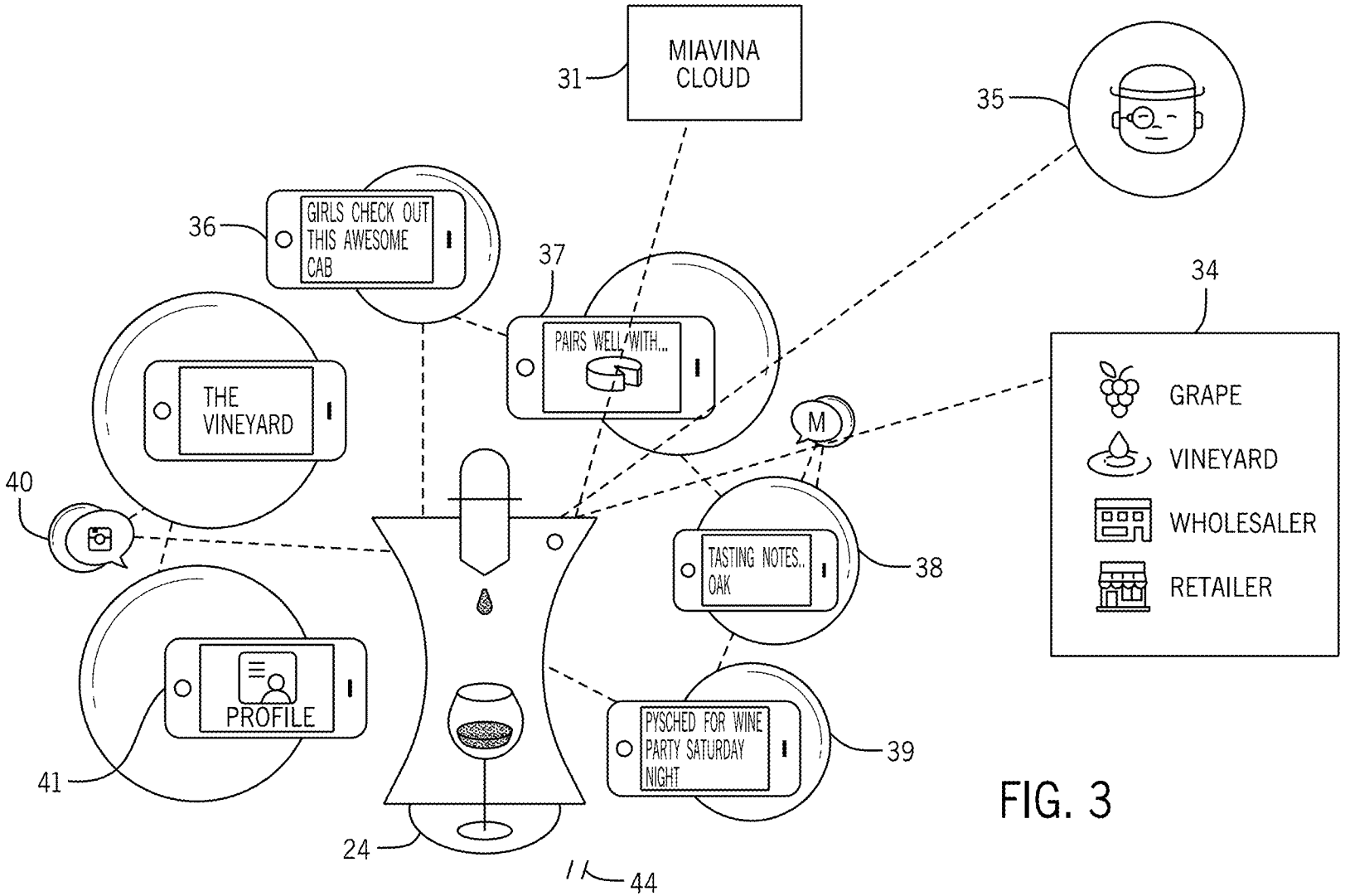
FIG. 3 is an illustration of an example software application and its interactive features as disclosed herein.

FIG. 3 illustrates the user digital/software application 32, which may also be implemented as a website and accessed by a computing device and/or portable user device. The content is the same through both platforms. Once the power cord 27 is plugged in and the system 100 is turned on, the PCB Board 5 will transmit a Wi-Fi signal to any Wi-Fi device within a close proximity to the system. The Wi-Fi Signal 44 will notify the user device 32 that a system is in close range and prompt the user to engage with that particular system. The user may synchronize its device with the system 100 and will be funneled through a general user set-up to generate a unique profile 41, including data inputs such as e.g.; age, gender, zip, preferences on varietals, brands and regions. Once user preferences are entered and user set-up is complete, the system 100, via it's Wi-Fi connection 44 and it's PCB board 5, will start collecting data and periodically transmitting it back to the cloud computer/application 31. As data accumulates, the IOT library 34 will build its catalog of information, refine assortments and prompt the digital sommelier 35 to begin making wine recommendations 36, food and wine pairings 37, offer tasting notes 38, recommend Geo-located events 39 and on-premises tastings and allow the user to load images 40 to social media accounts and other connected third party sites.

Figure 4:
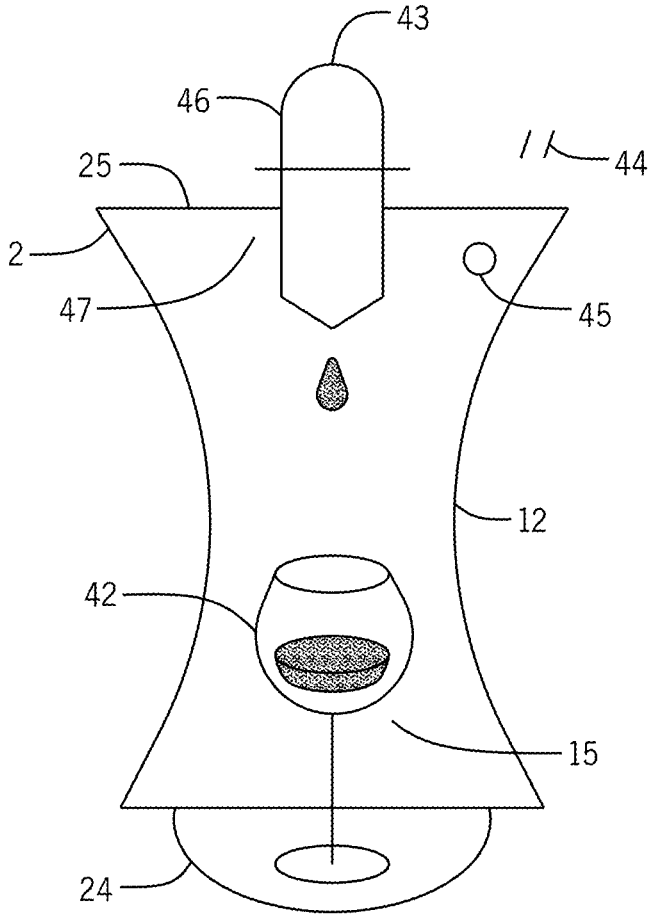
FIG. 4 is an illustration of technology features included in at least one embodiment of the disclosed system.

FIG. 4 illustrates details of some of the features of the system 100 disclosed herein. The vessel entrance 2 is a lightweight cover that lifts up easily exposing the vessel bay 10 for product insertion. There is a drip tray 24 to catch any over pouring or drips from the faucet 26. The volume sensor lights 25 display liquid volume levels and automatically adjust as product is depleted. The built-in aerator 46 introduces oxygen to the wine as it is poured to allowing for an 'opening' or 'breathing' process to the wine to highlight tasting notes. The micro-chip set 42 measures sulfur and oxygen levels to indicate the stability of the product. The kinetic pour 43 mechanism simulates the pouring of wine at an angle to resemble that of the bottle pour. The Wi-Fi connectivity allows the PCB board 5 to communicate system interactions back to the cloud computer/application 31. The vessel dock subsystem 12 creates an oxygen impermeable seal to each package creating a source of pressure and wine stabilization. The temperature system 15 monitors liquid temperature and automatically sets each chamber to the pre-set temperature suggested for unique varietals. The on/off button 45 turns the system on and off. The LED lights 47 are vibrant as long as the system is plugged in.

Figure 5A:
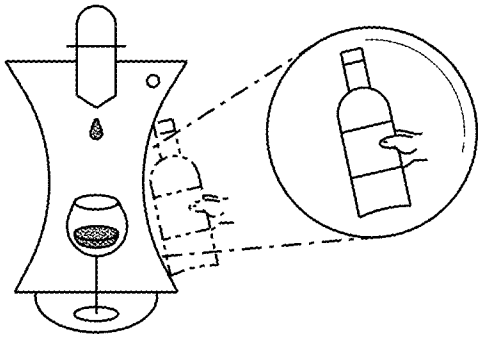
FIG. 5 is an illustration of sample features of at least one embodiment of the disclosed system.
Figure 5B:
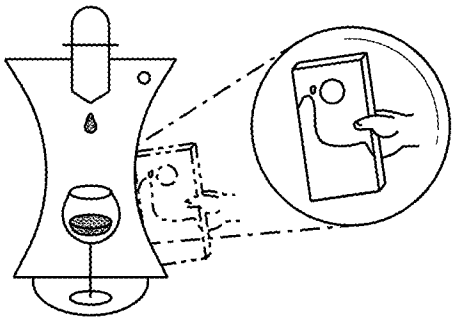
Figure 5C:
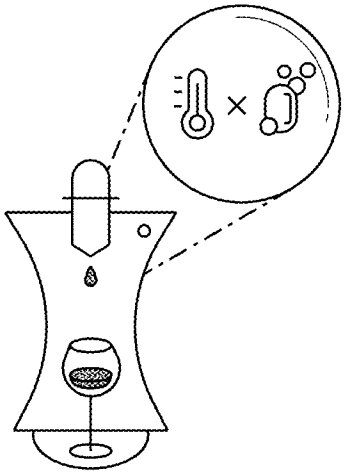
Figure 5D:
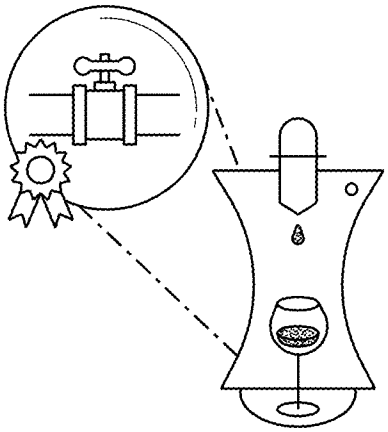
Figure 5E:
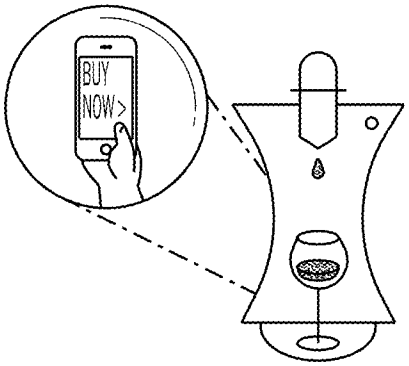

FIG. 5 illustrates various features of the system including: interchangeable package allowance, as shown in FIG. 5A, accepting either bottles or quartinas, as shown in FIG. 5B, proprietary sustainable wine pods, as shown in FIG. 5C, automated temperature and aeration levels, as shown in FIG. 5D, direct-to-consumer shipping via in-application purchases, as shown in FIG. 5E, extended shelf-life of product through preservation and elimination of oxygen introduction.

Figure 6:
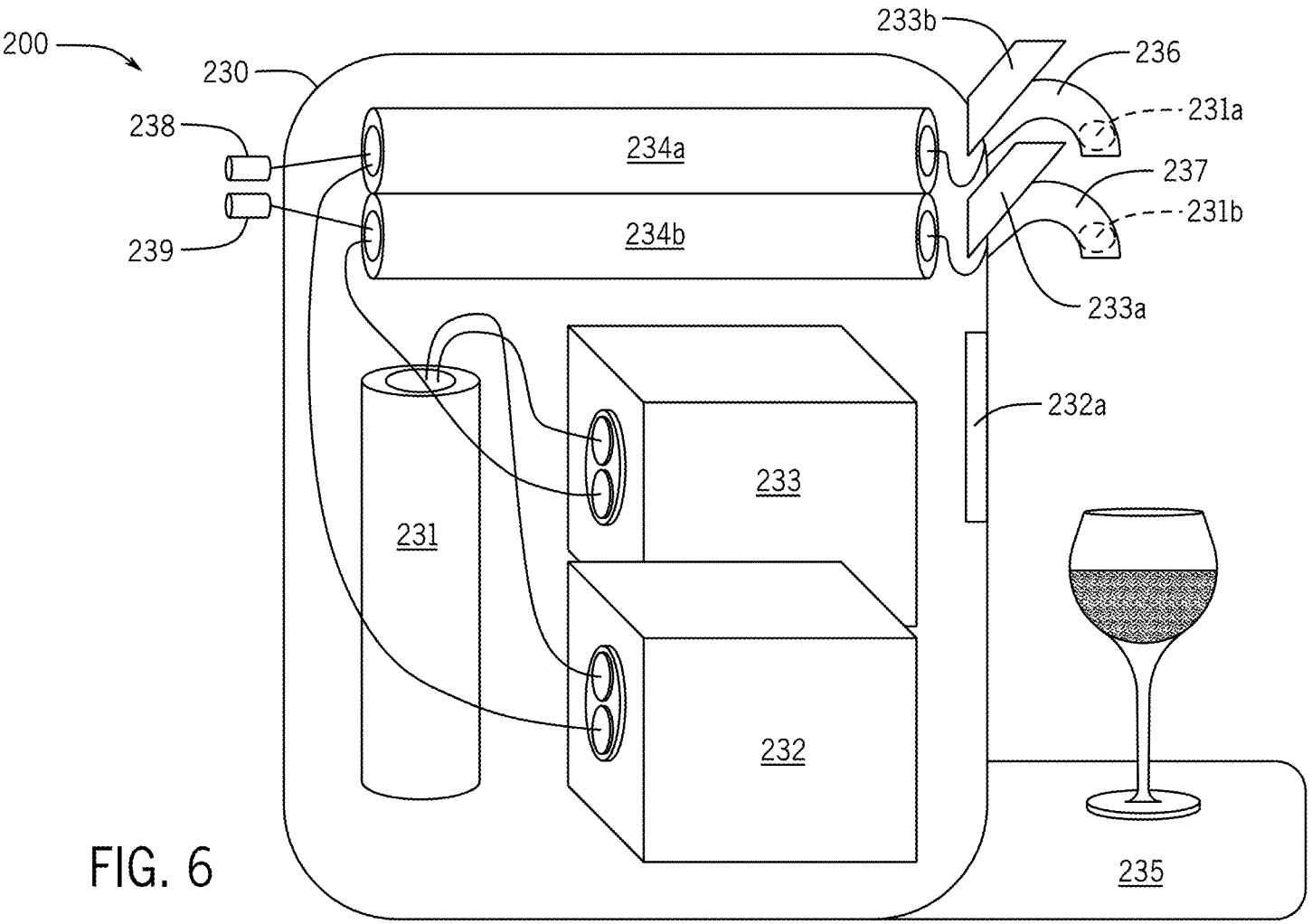
FIG. 6 is an illustration of an embodiment of the system using nitrogen gas for preservation and propulsion.

FIG. 6 illustrates a second system 200 disclosed herein. The illustrated system uses a nitrogen tank 231 for wine preservation and propulsion. The tap-wine dispenser casing 230 houses the internal parts of the system including the nitrogen tank 231, a first Quartina 232 for holding a first liquid/wine and a second Quartina 233 for holding a second liquid/wine. Both chambers have unique temperature settings including cooling chamber 234*a* for the first liquid/wine and cooling chamber 234*b* for the second liquid/wine. The first liquid/wine will pass over a micro-chip set 231*a* while the second liquid/wine will pass over micro-chip set 231*b*. The first liquid/wine and the second liquid/wine will pass through separate nozzles—i.e., faucet 236 for the first liquid/wine and faucet 237 for the second liquid/wine. There is a drip tray 235 to catch over-pouring and drips. Each chamber has a temperature gauge 238 for chamber 1 and temperature gauge 239 for Chamber 2. There is an exterior data screen 232*a* for displaying product information such as e.g., wine name/type, temperature, volume, etc. Wine is released when a user pulls lever 233*a* (for the first liquid/wine) and/or lever 2 233*b* (for the second liquid/wine).

It should be appreciated that the disclosed embodiments can come in various package sizes, including but not limited to: a 2-Liter Quartina, 5-Liter Quartina, 10-Liter Quartina and 20-Liter Quartina. These packages are intended to hold wine, beer, spirits, mixed drinks and non-alcoholic beverages including: water, milk and juice. As such, the disclosed embodiments are not to be limited to dispensing wine.

Figure 7:
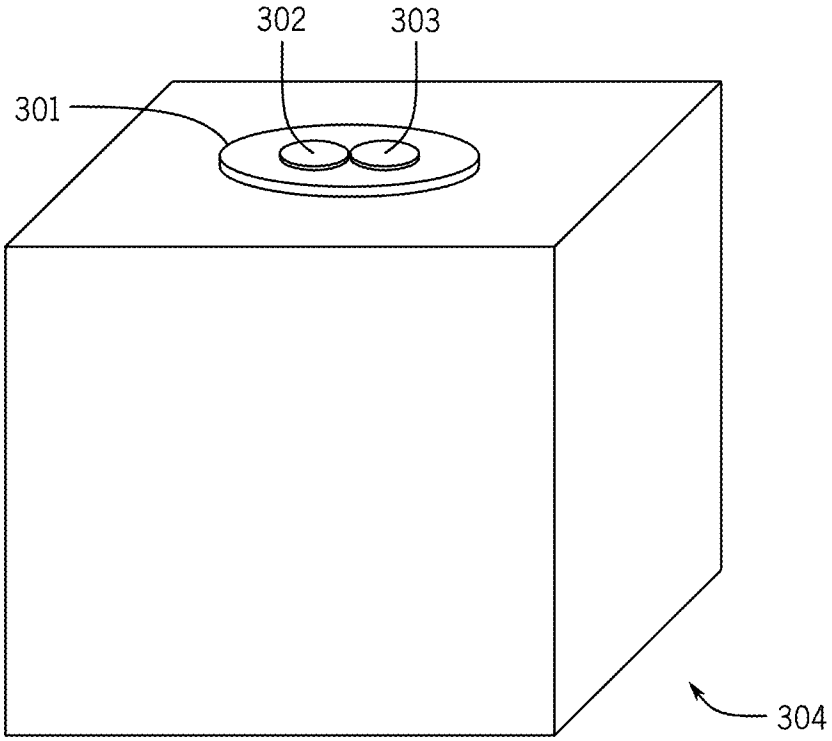
FIG. 7 is the side view of an example Quartina used in the FIG. 6 system.

FIG. 7 illustrates the side-view of an example Quartina 304. The Quartina 304 includes a gas-in line 302. Still liquids will use an inert gas like nitrogen or argon and carbonated liquids will use carbon dioxide or compounds including carbon dioxide. The Quartina has a valve 301 and a liquid out-line 303. Sizes for the Quartina 232, 233 that are appropriate for the commercial consumers include e.g., a 2-Liter Quartina, 5-liter Quartina, 10-liter Quartina and 20-liter Quartina.

It should be appreciated that the disclosed Quartina embodiments can come in various small, consumer oriented package sizes including: a 1.5 L Quartina, 1 Liter Quartina, 750 ML Quartina, 500 ML Quartina, and 375 ML Quartina. Quartina's are made up of eco-friendly recyclable material and offer extended shelf-life to wines by using and oxygen impermeable seal.

It should be appreciated that the disclosed embodiments that the disclosed embodiments should not be limited to use with two vessels (or to the dispensing of two liquids). As can be appreciated, the disclosed systems could contain a vessel bay subsystem that only contains one vessel dock and would accommodate only one vessel. In this configuration, the dispenser would have only one spout and the other subsystems could contain just the components needed to accommodate one vessels. As can also be appreciated, the disclosed systems could contain a vessel bay subsystem that contains more than two vessel docks and would accommodate more than two vessels. In this configuration, the dispenser would have a corresponding number of spouts and the other subsystems would contain sufficient components to accommodate more than two vessels.

It should be appreciated that the disclosed embodiments offer several features and advantages. For example, the systems will capture certain sensory elements that simulate the same effects from a bottle pour. As with the pour from a bottle, the liquid as it leaves the system will hit the glass at a certain rate, vs. a mechanical pressurized tap approach. The aural sensation of using a manual aerator in which the user can actually hear the aeration process. The tasting notes from the label and romantic design will be replicated in the app and on the system screen.

The technology disclosed herein may include e.g., an on-off button with LED lighting; finger print scanner that recognizes users and syncs with each user handheld application; drip tray drops down automatically when system is turned on; an LED logo; dual-zone temperatures for both Quartinas and/or bottles, allowing for one red wine and one white wine or two reds and two whites (e.g., flash-chill, refrigeration, etc.); Bluetooth or wireless technology to interact directly with the users phone or tablet; UCC, RFID, Barcode or NFC technology for the Quartina reader/scanner to automatically synchronize with the system when the user inserts a new vessel; kinetic pour mechanism; pressurized seal for spout of Quartina to system as engaged with vessel dock; measured pour by weight; measured depletion rate and corresponding indicator on the system; pump system for extraction and preservation of wine; and/or a remote on/off feature to initialize the chiller from dormant state or ambient temperature (and for energy conservation).

The disclosed embodiments may provide one or more of the following application and/or data functions: all data collected is stored in a connected cloud server; all data for each unique system and user is stored in the system PCB and synced to the Cloud then directly to the user app to track history, product usage, identifying varietals and wine styles that the user likes/dislikes; if the user likes this, then the user will "like" that feature; social networking to allow users to find other system users with GPS locators (coordinate events, make product recommendations, schedule tastings and in-home parties with other system users, etc.); re-order wines; order sample packs; push notifications of flash-flash sales, promotions, wine clubs, members-only events, etc.; and/or a chat function (e.g., "ask a sommelier"—ask questions to in-house sommeliers about winemaking, products, taste profiles, etc.).

The disclosed embodiments may provide one or more of the following Quartina insertion an locking mechanisms: a claw locking mechanism to hold Quartina in place from the bottom at the vessel dock; front covert trap-door to open and insert from the top; sliding vessel rail allows easy insert and remove new/empty Quartinas; second locking mechanism in the form of a clamp, lever or pushing motion to keep Quartina firmly in place; and/or a lever that initiates the engagement liquid/air line-in and liquid line-out.

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A liquid dispensing system comprising:

a housing comprising a dispenser;

a first subsystem within the housing and adapted to accept at least one vessel comprising a liquid to be dispensed;

a second subsystem within the housing and adapted to connect the at least one vessel to the dispenser and to provide the liquid from the at least one vessel to the dispenser when the dispenser is activated;

a third subsystem within the housing and adapted to monitor a status of the liquid from the at least one vessel and to output the status; and a fourth subsystem within the housing and adapted to determine a desired temperature for the liquid from the at least one vessel, wherein the second subsystem comprises means for heating or cooling the liquid from the at least one vessel to the desired temperature.

2. The system of claim 1, wherein the fourth subsystem comprises a sensor adapted to determine a type of liquid in the at least one vessel and the third subsystem controls the second subsystem to heat or cool the liquid within the at least one vessel based on stored information about the determined type of liquid in the at least one vessel.

3. The system of claim 2, wherein the information about the determined type of liquid in the at least one vessel is retrieved over a network connection.

4. The system of claim 1, wherein the fourth subsystem comprises a sensor adapted to determine an amount of liquid remaining in the at least one vessel, and the third subsystem outputs the determined amount of liquid remaining in the at least one vessel to a networked computer or a user device in communication with the third subsystem.

5. The system of claim 1, wherein the second subsystem comprises at least one pump adapted to pump the liquid from the at least one vessel.

6. The system of claim 1, further comprising an information display mounted on the housing, the information display adapted to display information concerning the status of the liquid in the at least one vessel.

7. The system of claim 1, wherein the first subsystem is adapted to accept a bottle comprising an adapter that interfaces with a valve of the first subsystem.

8. The system of claim 1, wherein the first subsystem is adapted to accept a Quartina.

9. The system of claim 1, wherein the dispenser comprises an aerator.

10. The system of claim 1, wherein the third subsystem communicates the status of the liquid from the at least one vessel to a networked computer or a user device in communication with the third subsystem.

11. A liquid dispensing system comprising: a housing comprising a dispenser;

a first subsystem within the housing and adapted to accept at least one vessel comprising a liquid to be dispensed;

a second subsystem within the housing and adapted to connect the at least one vessel to the dispenser and to provide the liquid from the at least one vessel to the dispenser when the dispenser is activated; and a third subsystem within the housing and adapted to monitor a status of the liquid from the at least one vessel and to output the status, wherein the second subsystem comprises a gas propulsion mechanism adapted to pump the liquid from the at least one vessel.

12. A liquid dispensing system comprising:

a housing comprising a dispenser with first and second pour spouts;

a first subsystem within the housing and adapted to accept first and second vessels respectively comprising first and second liquids to be dispensed;

a second subsystem within the housing and adapted to connect the first vessel to the first pour spout of the dispenser and to connect the second vessel to the second pour spout of the dispenser, the second subsystem being adapted to provide the first liquid from the first vessel to the first pour spout and to provide the second liquid from the second vessel to the second pour spout;

a third subsystem within the housing and adapted to monitor a status of the first and second liquids and to output the status of the first and second liquids; and a fourth subsystem within the housing and adapted to determine a respective desired temperature for the first and second liquids, wherein the second subsystem comprises means for heating or cooling the first and second liquids to the respective desired temperatures.

13. The system of claim 12, wherein the fourth subsystem comprises sensors adapted to determine the first liquid's type and the second liquid's type, and wherein the third subsystem controls the second subsystem to heat or cool the first and second liquids based on stored information about the determined first liquid's type and the determined second liquid's type.

14. The system of claim 12, wherein the fourth subsystem comprises a sensor adapted to determine an amount of liquid remaining in the first and second vessels, and the third subsystem outputs the determined amounts of liquid remaining in the first and second vessels to a networked computer or a user device in communication with the third subsystem.

15. The system of claim 12, further comprising an information display mounted on the housing, the information display adapted to display information concerning the status of the first and second liquids.

16. The system of claim 12, wherein the first subsystem is adapted to accept a bottle comprising an adapter that interfaces with a valve of the first subsystem.

17. The system of claim 12, wherein the first subsystem is adapted to accept a Quartina.

18. The system of claim 12, wherein the wherein the third subsystem is adapted to communicate with a networked computer or a user device in communication with the third subsystem.

* * * * *